US005726389A

United States Patent [19]

Hogeveen et al.

[11] Patent Number: 5,726,389

[45] Date of Patent: Mar. 10, 1998

[54] CABLE SHIELD CLAMP

[75] Inventors: Robert-Jan Hogeveen, Eindhoven; Jacobus Nicolaas Tuin, Best, both of Netherlands

[73] Assignee: The Whitaker Corporation, Wilmington, Del.

[21] Appl. No.: 635,044

[22] Filed: Apr. 19, 1996

[30] Foreign Application Priority Data

Apr. 24, 1995 [GB] United Kingdom ..... 9508286

[51] Int. Cl.[6] ..... H01R 4/66

[52] U.S. Cl. ..... 174/78; 174/84 C

[58] Field of Search ..... 174/78, 84 C, 174/40 CC, 135; 439/98, 99; 29/868, 872

[56] References Cited

U.S. PATENT DOCUMENTS

| | | | |
|---|---|---|---|
| 3,435,126 | 3/1969 | Hamilton | 174/78 |
| 3,887,895 | 6/1975 | Pierzchala | 439/98 |
| 4,080,024 | 3/1978 | Kroon | 439/98 |
| 4,791,237 | 12/1988 | Sherman | 174/40 R X |
| 4,892,979 | 1/1990 | Rossow | 174/153 G X |
| 5,281,761 | 1/1994 | Woo et al. | 174/78 |
| 5,418,330 | 5/1995 | Rook | 174/78 |

FOREIGN PATENT DOCUMENTS 2199198 6/1988 United Kingdom .

*Primary Examiner*—Kristine L. Kincaid
*Assistant Examiner*—Chau N. Nguyen
*Attorney, Agent, or Firm*—Driscoll A. Nina

[57] ABSTRACT

A cable shield clamp has a body section having a cable receiving cavity extending therethrough. The cavity has a forward tapered portion for wedging the cable shielding therein to improve shielding connection between the cable and the clamp. The cable shield clamp further has a clamping mechanism having a supple or ductile band extending around the cavity through a slot in the clamp body. The band can be tightened by twisting around a pivotable member in order to securely clamp the cable.

10 Claims, 3 Drawing Sheets

CABLE SHIELD CLAMP

BACKGROUND OF THE INVENTION

1. Field of the Invention

This invention relates to a clamp for securing a shielded cable to a connector assembly, and ensuring continuation of grounding and shielding of the inner conductors.

2. Description of the Prior Art

Shielded cables are commonly used for the transmission of high speed data signals where the shielding reduces emission and reception of electromagnetic interference. The weak point in most interconnection systems when considering noise emission or reception, is usually at the connector, where the cable inner conductors are exposed. Effective continuation of the shielding between the cable and the connector shielding is thus an important feature of an interconnection system, which however poses problems due to the difficulty of providing a good interconnection between the cable shield and the connector shield—i.e. perfectly "electromagnetically sealed". In order to electromagnetically seal the connection between the cable and the connector shielding, it is necessary to reduce or even eliminate spaces or gaps between the cable shielding and the connector shielding. Furthermore, the cable must be securely held to the connector.

Conventional clamps that also interconnect the cable shielding to the connector are provided in many different forms. A typical means is to provide two members (e.g. two half shells, or one half shell mountable to a panel) that are bolted or latched together to clamp the cable therebetween, where one of the members is part of the connector shielding. This clamping does not adjust effectively to variations in the diameter of the cable due to pre-formed cable receiving shapes, thus allowing gaps between the clamp and the cable shielding. It would therefore be desirable to provide a cable shield clamp that eliminates all gaps between connector shielding and the cable shielding, and which is usable for a range of cable diameters. It would also be desirable to increase the versatility of such a cable shield clamp by allowing the cable to be orientated at a 90° or 0° angle with respect to the connector, without requiring a new cable clamp.

SUMMARY OF THE INVENTION

It is therefore an object of this invention to provide a cable shield clamp with effective electromagnetic shielding.

It is an object of this invention to provide a cable shield clamp with effective shielding, that can adjust to a range of cable diameters.

It is a further object of this invention to provide a cable shield clamp with effective shielding, that can be used with a connector for incoming cables extending at 0° or 90° with respect to that connector.

It is a further object of this invention to provide a cable shield clamp that is compact, and that can be used in compact environments, for example where a plurality of connector assemblies are closely spaced together.

The objects of this invention have been achieved by providing a cable shield clamp having a body section and a clamping section, the body section comprising a cable receiving through cavity having a substantially conical section for abutment with shielding of a cable. As the cable is generally circular, the latter thus ensures that there is no gap between the cable shielding and the cable clamp even for different diameters of cable. The cable clamp may advantageously comprise a band encircling the cable receiving cavity and positioned proximate the cable receiving end in a transverse slot of the cable clamp, the band attached to the cable clamp at one end and engaged by a tightening mechanism proximate the other end to draw the band in tension around a cable positioned in the cable clamp. The band thus clamps the cable around the whole circumference and can adjust to a large range of cable diameters without effecting the clamping effectiveness. The tightening mechanism may comprise a pivotable pin member mounted in bearings flanking the band receiving slot, the pin member comprising an axial slot for receiving the band therethrough for twisting the band around the pin member.

DETAILED DESCRIPTION OF THE PREFERRED EMBODIMENT

Figure 2:
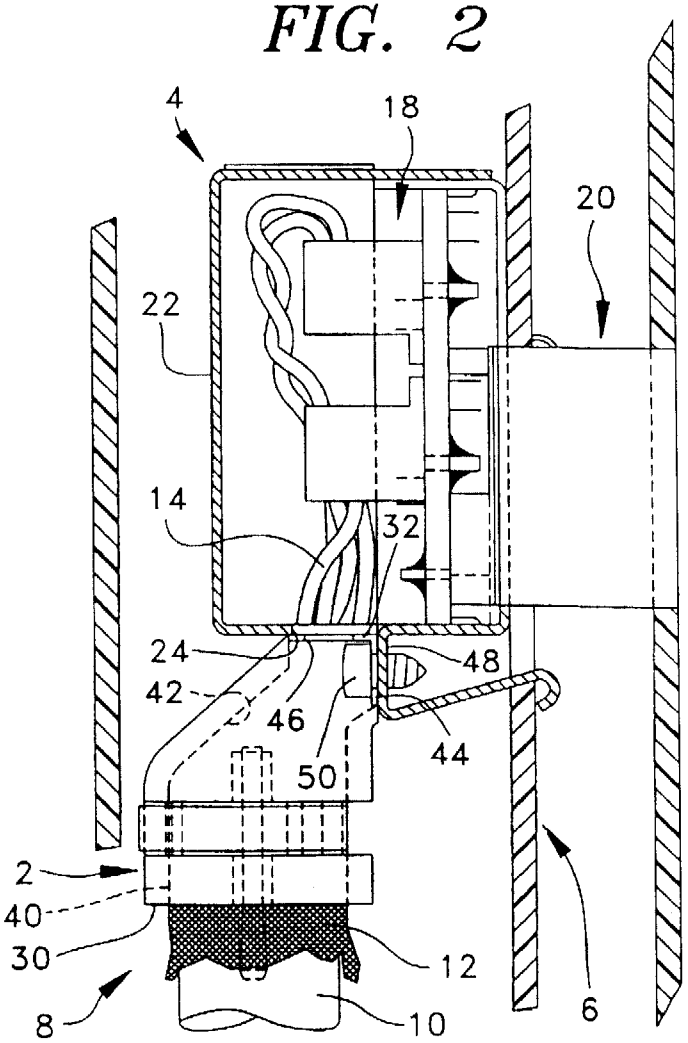
FIG. 2 is a cross-sectional view through lines 2—2 of FIG. 1.
Figure 1:
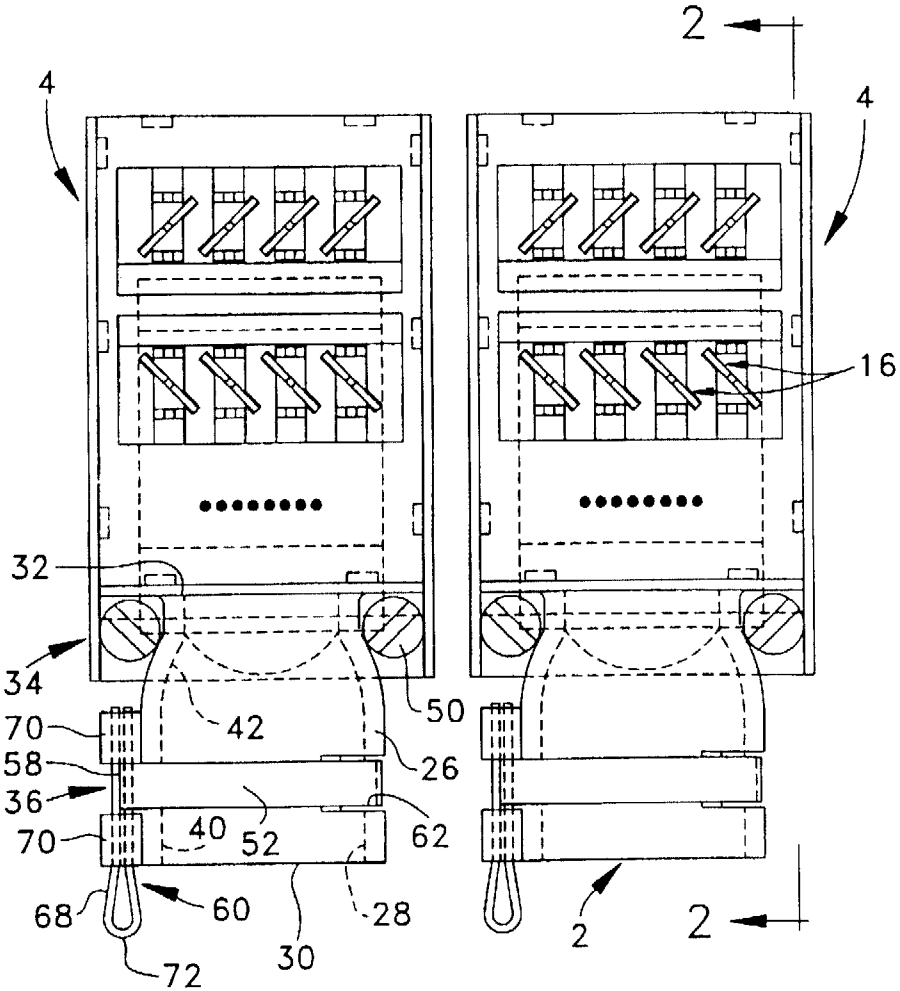
FIG. 1 is a top view of a pair of connector assemblies with cable shield clamps connected thereto.

Referring to FIGS. 1 and 2, a cable clamp 2 is shown mounted to a shielded connector assembly 4, the shielded connector assembly 4 being mounted on a panel 6 where a plurality of connector assemblies 4 can be mounted in a juxtaposed relationship closely together. A shielded cable 8 is for connection to the connector assembly 4, and comprises an outer insulative jacket 10 surrounding a conductive shielding layer 12 which surrounds a plurality of insulated individual conducting wires 14 that are for connection to terminals 16 of the connector assembly.

The connector assembly 4 comprises a connection section 18 for connection to the cable, and a mating section 20 for connection to a complementary connector. The connection section 18 and mating section 20 of the connector assembly 4 could have a design comprising a number of the known interconnection designs, and will not be described in any detail. The connector assembly 4 further comprises a conductive shield 22 that substantially completely surrounds the connection section to prevent emission and reception of electromagnetic noise from the insulated conducting wires 14 that are exposed (i.e. not surrounded by the cable shielding 12) for electrical connection to the connection section 18. An opening 24 in the shield 22 must however be provided as an inlet for the conducting wires 14.

Referring now to FIGS. 1, 2 and 5–8, the cable shield clamp 2 will now be described in more detail. The cable clamp 2 comprises a conductive housing 26 having a cavity 28 extending therethrough from a cable receiving end 30 to a connector end 32 for receiving a connection end of the cable 10 therein. The shield clamp 2 further comprises a mounting section 34 for mounting the clamp to the connector assembly, and a clamping section 36. The cable receiving cavity 28 has a substantially cylindrical portion 40 extending from the cable receiving end 30, and an inwardly tapered portion 42 that extends between the connector end 32 and the cylindrical portion 40.

Figure 4:
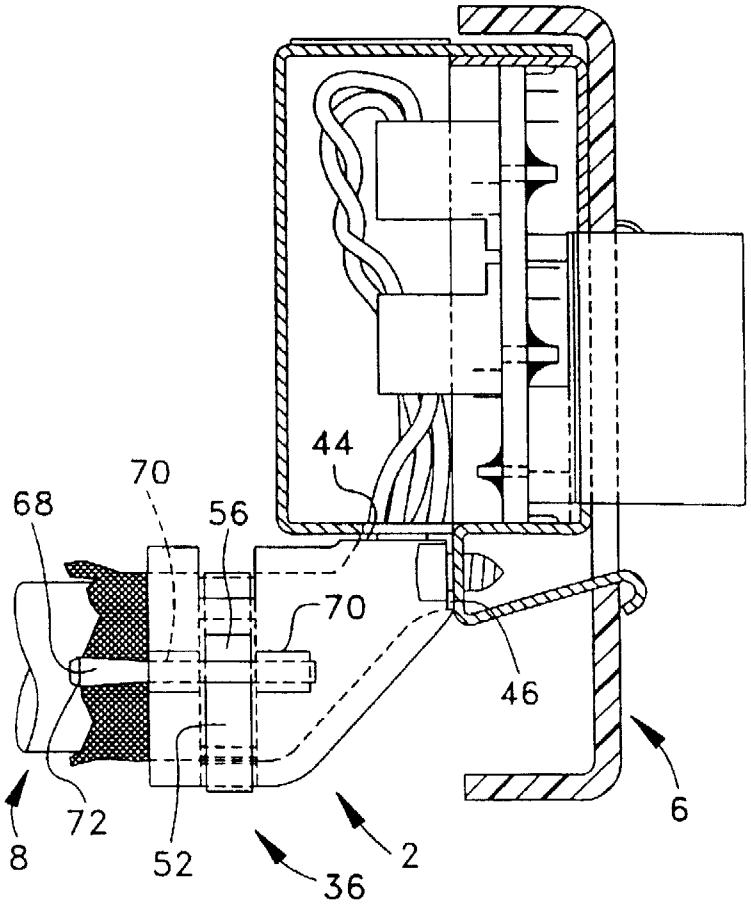
FIG. 4 is a cross-sectional view through lines 4—4 of FIG. 3.
Figure 3:
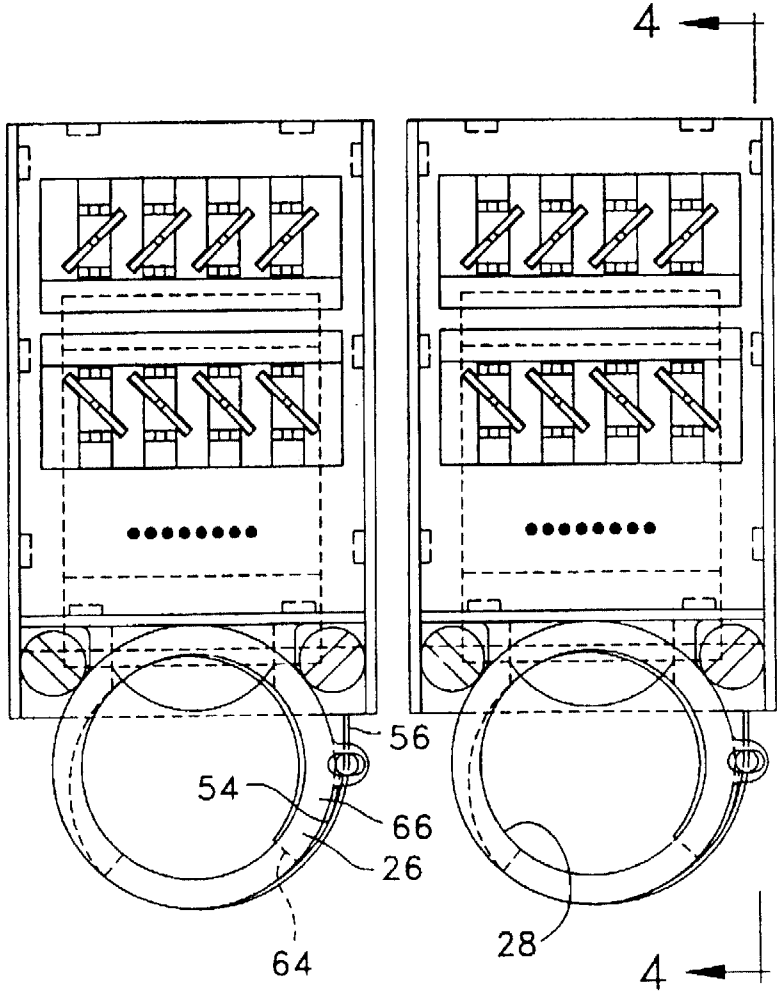
FIG. 3 is a similar view to that of FIG. 1 except that the cable shield clamps are oriented at 90° with respect to the connectors (if the orientation of FIG. 1 is considered to be 0°)
Figure 5:
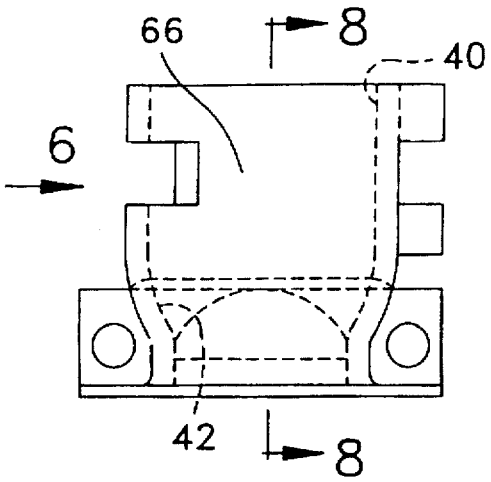
FIG. 5 is a top view of the cable shield clamp of FIGS. 1–4.
Figure 6:
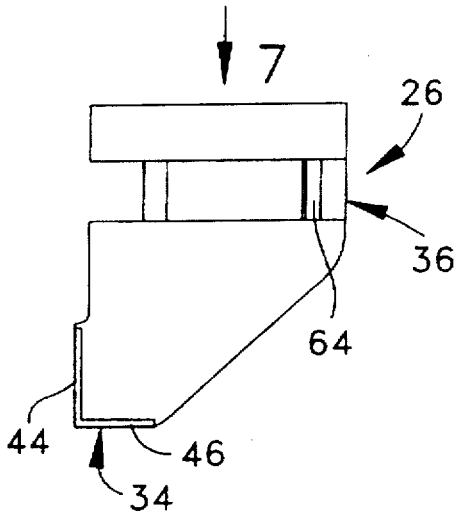
FIG. 6 is a view in the direction of arrow 6 of FIG. 5.
Figure 7:
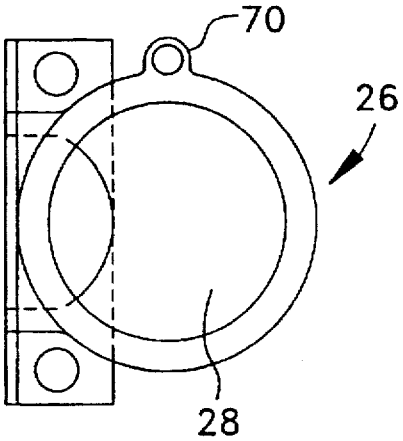
FIG. 7 is a view in the direction of arrow 7 of FIG. 6.
Figure 8:
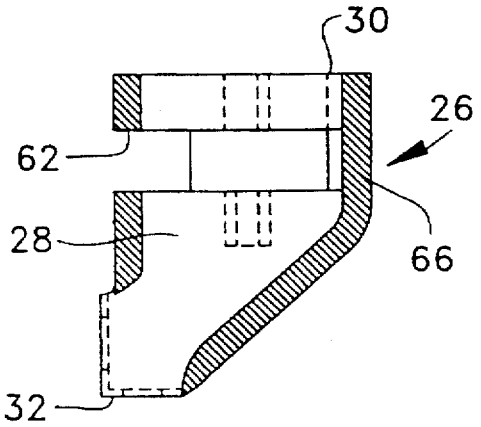
FIG. 8 is a cross-sectional view through lines 8—8 of FIG. 5.

The mounting section 34 comprises a first flange portion 44 that extends in a planar direction substantially parallel to the longitudinal axis of the cylindrical portion 40 of the cable receiving section, and a second flange portion at a right angle thereto such that the mounting section 34 forms a right angle corner. Each of the flange portions 44,46 have means for mounting to a mounting member 48 of the connector assembly shield 22. In this embodiment the mounting means are holes through the flanges for passing threaded bolts or screws 50 therethrough. The cable receiving cavity 28 spans across both faces of the flanges 44,46 at the connection end 32 such that the conducting wires 14 can extend through the cavity 28 past the first flange 44 as shown in FIG. 4, or past the second flange at a right angle 46 as shown in FIG. 2. This therefore allows the cable clamp to be positioned in two different manners to allow entry of the cable 10 substantially parallel to the panel 6 (0°) as shown in FIG. 2 or at 90° thereto as shown in FIG. 4 without requiring the use of different or other components. The latter thus increases the versatility and decreases the cost of using the cable clamp 2.

The clamping section 36 comprises a thin deformable band 52 encircling the cable receiving cavity 28, having one end 54 attached to the body 26, and the other free end 56 inserted through a slot 58 of a tightening mechanism 60. The body 26 has a transverse cutout 62 having a width slightly greater than the width of the band 52 and extending around a substantial portion of the circumference of the body 26. The band 54 extends from its attachment portion 54 around one edge 64 of the cutout and then extends along the portion of wall 66 extending between the cutout ends, and then passes into the cutout 62 and out again through to the free end 56. A cable positioned within the cable receiving cavity 28 can thus be clamped to the cable shield clamp 2 by tensioning the band 52 which is drawn through the cutout 62 to wrap tightly around the whole circumference of the cable in a substantially circular manner. The latter is particularly advantageous in that the band 52 can be tightened around cables with a large range of diameters that are positioned within the cavity 28. Furthermore, the clamping is effectuated without substantially deforming the cable out of its cylindrical shape.

The tightening mechanism 60 comprises a pivotable member 68 pivotably mounted in supports 70 flanking either side of the band 52. The pivotable member 68 comprises a slot 58 through which the end 56 of the band 52 extends. A handle 72 is provided for pivoting the tensioning mechanism. Tensioning of the band 52 is effectuated by rotating the pivotable member 68 such that the band 52 is wrapped therearound. The band 56 can either be of a very supple material that can wrap around itself on the pivotable member 68, but could also be a very ductile material.

The clamping mechanism described above does not require the body of the cable shield clamp to be made in two pieces that are clamped together, and furthermore is a very compact arrangement due to the compact tensioning mechanism and the clamping band 52 that does not substantially increase the outer dimensions of the shield clamp nor require much space for assembly and disassembly of the clamping mechanism. Furthermore, tensioning can be easily effectuated with simply a pair of pliers, for example, to rotate the pivot member 60 which remains fixed to the shield clamp and therefore cannot be lost (contrary to screw fixing means for example).

A shielded cable 8 can thus be clamped to the cable shield clamp 2 by first pulling its shielding layer 12 in a reversely folded manner over the outer insulation 10, and inserting the cable until the front end of the shielding abuts the tapered section 42 of the cavity 28. The cable can then be clamped to the shield clamp 2 by twisting the tensioning member 60 whilst the cable is held in abutment with the tapered section 42. Engagement of the tapered section 42 with the cable shield 12 thus eliminates any gaps therebetween, thereby reducing leakage of electromagnetic noise. This is also particularly advantageous in that the tapered section 40 is positioned well within the cavity 28 so that if slight leakage does occur, the cylindrical portion of the body and the clamp section will provide further shielding.

Advantageously therefore, this invention provides effective shielding connection to a shielded cable in addition to providing a compact clamping mechanism for secure, reliable fastening to the cable. Furthermore, the clamp is adapted to be oriented in two different positions such that the cable inlet can be directed at 0° or 90° to the connector assembly.

We claim:

1. A cable shield clamp for clamping a shielded cable to a shielded connector assembly and providing shielding continuity therebetween, the shield clamp comprising a conductive housing, a mounting section for mounting the clamp to the connector assembly, and a clamping section for securing the cable to the clamp, characterized in that the clamping section comprises a tightening mechanism, and a supple band attached at one end to the conductive housing and extending therefrom around a cable receiving cavity of the housing, the band having a free end portion that can be pulled by the tightening mechanism to clamp the cable therearound, further wherein the housing comprises a circumferential cut-out surrounding the cavity through add along which the band extends.

2. A cable shield clamp for clamping a shielded cable to a shielded connector assembly and providing shielding continuity therebetween, the shield clamp comprising a conductive housing, a mounting section for mounting the clamp to the connector assembly, and a clamping section for securing the cable to the clamp, characterized in that the clamping section comprises a tightening mechanism, and a supple band attached at one end to the conductive housing and extending therefrom around a cable receiving cavity of the housing, the band having a free end portion that can be pulled by the tightening mechanism to clamp the cable therearound, and wherein the tightening mechanism comprises a pivotable member rotatably mounted in supports of the housing for pulling the band when rotated.

3. The cable shield clamp of claim 2 characterized in that the pivotable member comprises a slot for receiving and securing the free end portion of the band thereto, the band being windable around the pivotable member.

4. The cable shield clamp of claim 1 characterized in that the cable receiving cavity extends from a cable receiving end to a connector end of the housing, the cavity having a substantially cylindrical portion proximate the cable receiving end, and an inwardly tapered portion extending therefrom proximate the connector end, the inwardly tapered portion abuts with shielding at an end of the cable.

5. The cable shield clamp of claim 4 characterized in that the tapered portion is roughly conical in shape.

6. The cable shield clamp of claim 1 characterized in that the mounting section comprises a first mounting flange and a second mounting flange substantially orthogonal thereto for attachment to shielding of the connector assembly, whereby the cable receiving cavity spans across both of the flanges to enable orientation of the cable with respect to the connector assembly in two substantially orthogonal directions.

7. A cable shield clamp for clamping a shielded cable to a shielded connector assembly and providing shielding continuity therebetween, the shield clamp comprising a conductive housing, a mounting section for mounting the clamp to the connector assembly, and a clamping section for securing the cable to the clamp, characterized in that a cable receiving cavity extends from a cable receiving end to a connector end of the housing, the cable receiving cavity having a substantially cylindrical portion proximate the cable receiving end, and an inwardly tapered portion extending therefrom proximate the connector end, the inwardly tapered portion abuts with shielding at an end of the cable.

8. The cable shield clamp of claim 7 characterized in that the tapered portion is roughly conical in shape.

9. The cable shield clamp of claim 7 characterized in that the mounting section comprises a first mounting flange and a second mounting flange substantially orthogonal thereto for attachment to shielding of the connector assembly, whereby the cable receiving cavity spans across both of the flanges to enable orientation of the cable with respect to the connector assembly in two substantially orthogonal directions.

10. The cable shield clamp of claim 2 characterized in that the mounting section comprises a first mounting flange and a second mounting flange substantially orthogonal thereto for attachment to shielding of the connector assembly, whereby the cable receiving cavity spans across both of the flanges to enable orientation of the cable with respect to the connector assembly in two substantially orthogonal directions.

* * * * *